US006021917A

United States Patent [19]

Lovell et al.

[11] Patent Number: 6,021,917

[45] Date of Patent: Feb. 8, 2000

[54] PAIL AND PLASTIC LID COMPRISING NON-LINEAR, FLEXIBLE RIBS

[75] Inventors: Peter J. Lovell, Oakville; Stephen H. Arshinoff, Willowdale, both of Canada

[73] Assignee: Industrial Containers Ltd., Toronto, Canada

[21] Appl. No.: 08/811,760

[22] Filed: Mar. 6, 1997

[30] Foreign Application Priority Data

Mar. 7, 1996 [GB] United Kingdom ..... 9604808

[51] Int. Cl.[7] ..... B65D 41/18

[52] U.S. Cl. ..... 220/782; 220/780; 220/789; 220/790; 220/795; 220/315; 206/508

[58] Field of Search ..... 220/780, 782, 220/789, 790, 795, 315, 323, 324, 608, 623, 675, 659; 224/659, 241; 206/508

[56] References Cited

U.S. PATENT DOCUMENTS

| | | | |
|---|---|---|---|
| 1,825,726 | 10/1931 | Gredell | 220/315 X |
| 2,656,946 | 10/1953 | Clarke | 220/324 X |
| 3,510,023 | 5/1970 | Ullman et al. | 220/795 X |
| 3,804,289 | 4/1974 | Churan | 220/782 |
| 3,815,777 | 6/1974 | Churan . | |
| 4,004,710 | 1/1977 | Crisci | 220/780 |
| 4,004,734 | 1/1977 | Hadtke | 220/315 X |
| 4,126,923 | 11/1978 | Cislak et al. | 220/324 X |
| 4,127,785 | 11/1978 | Noguchi | 220/324 X |
| 4,212,415 | 7/1980 | Neely | 220/324 X |
| 4,380,305 | 4/1983 | Von Holdt | 220/782 |
| 4,388,998 | 6/1983 | Underwood et al. | 220/780 |
| 4,512,493 | 4/1985 | Von Holdt | 220/784 X |
| 4,574,974 | 3/1986 | Von Holdt | 220/782 |
| 4,632,272 | 12/1986 | Berenfield et al. | 220/780 X |
| 4,757,894 | 7/1988 | Schreckenstein | 224/241 X |
| 4,848,570 | 7/1989 | Gosciniak | 220/350 X |
| 4,880,116 | 11/1989 | Kos | 220/324 X |
| 4,917,254 | 4/1990 | Ciriacks | 220/87.1 X |
| 5,088,616 | 2/1992 | Susko et al. | 220/343 |
| 5,199,276 | 4/1993 | Sullivan | 220/571 X |
| 5,307,949 | 5/1994 | Von Holdt . | |
| 5,325,981 | 7/1994 | Klomhaus et al. | 220/212 |
| 5,373,959 | 12/1994 | Haasewinkel | 220/802 X |
| 5,377,860 | 1/1995 | Littlejohn et al. | 220/790 |
| 5,458,256 | 10/1995 | Opheim | 220/345 |
| 5,584,408 | 12/1996 | Orkisz | 220/339 X |
| 5,593,056 | 1/1997 | Mero et al. | 215/382 |

FOREIGN PATENT DOCUMENTS

| | | |
|---|---|---|
| 2035277 | 10/1979 | United Kingdom . |
| WO 85/04382 A1 | 10/1985 | United Kingdom . |

*Primary Examiner*—Stephen P. Garbe
*Assistant Examiner*—Robin A Hylton
*Attorney, Agent, or Firm*—Fredrikson & Byron, P.A.

[57] ABSTRACT

A plastic lid for a pail. The lid has a substantially planar central section and a peripheral channel. The channel fits over the pail to effect closure thereof. The central section is spaced from the channel by a groove and a ridge, each of which extend around the lid juxtaposed to the channel, with the groove being adjacent to the channel. The pail is intended for transportation of goods.

12 Claims, 2 Drawing Sheets

PAIL AND PLASTIC LID COMPRISING NON-LINEAR, FLEXIBLE RIBS

The invention relates to a plastic lid for a pail and in particular to a plastic lid for a plastic pail, and the resultant pail with lid. The term "pail" is used herein to indicate a cylindrical container, which may be tapered especially towards its base, and which is closeable at one end with a lid. It is understood that the lid may be such that during normal use it is either removable or not readily removed, as discussed herein.

Metal pails and plastic pails are used in the transportation of goods, with the type of pail used depending particularly on the type of goods being transported. Regardless of the type of goods being transported, it is important that the lid for the pail be capable of being closed in a manner that retains the closure of the pail as a result of any internal pressure, and especially if the pail is dropped, during transportation and storage of the pail. In particular, if the pail is dropped on its side or its ends or especially on an edge, it is important that the lid not only remain on the pail but also do so in a leak-free manner. Moreover, the lid must be such that it will not leak during normal use.

Drop testing of filled and closed pails is commonly carried out by dropping a filled pail from a prescribed height onto a hard surface in various different orientations, especially including dropping the pail on an edge. A variety of regulations govern the specifications or properties of pails and other containers that may be used in transportation of goods, especially the regulation known as UN 1H2/Y1.5/40, and related regulations which are international regulations for transport of goods between countries.

The dropping of a pail or container on an edge can result in considerable pressure being exerted on the lid by the goods within the pail. Lids are known which exhibit flex properties intended to withstand the effect of such pressure, without causing the lid to pop off of the pail or container. Nonetheless, combinations of internal pail pressure, popping off of lids or distortion of the lids can result in leakage or spillage of goods from the pail, especially when the goods are in a liquid form.

A lid has now been found that further resists distortion and tendencies to pop off a container when the container is dropped.

Accordingly the present invention provides a plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel.

The present invention further provides a plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of non-linear flexible ribs therein extending across the width of the groove.

The present invention also provides a plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, at least one projection extending from said lid down the outside of the pail, said projection being substantially planar and having a forked lanceolate tip.

In a preferred embodiment of the lid, said forked lanceolate tip comprises two tynes that are inwardly flexible.

In further embodiments, the lids are intended for plastic pails.

In other embodiments, the lid has both a plurality of non-linear flexible ribs and said projection with forked lanceolate tip.

The present invention also provides a plastic pail with a plastic lid, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said lid optionally having a groove with a plurality of non-linear flexible ribs therein extending across the width of the groove;

said lid further optionally having at least one projection extending from said lid down the outside of the pail, said projection being substantially planar and having a forked lanceolate tip passed through an orifice and locked therein to prevent retraction of said tip through said orifice.

The present invention is illustrated by the embodiments shown in the drawings in which:

FIG. 1 shows a lid, generally indicated by 1, attached to a pail generally indicated by 2. As will be appreciated, only sections of lid 1 and pail 2 are shown.

Figure 1:
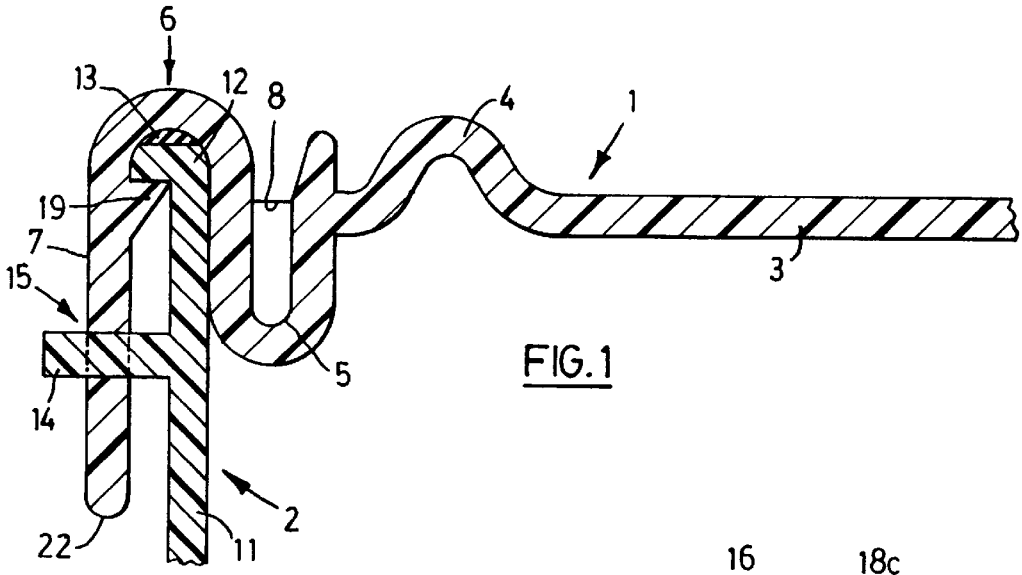
FIG. 1 is a schematic representation of a cross-section of a pail lid attached to a pail.

Lid 1 has a central planar section 3, which extends substantially across the width of the lid 1. Central planar section 3 is connected to ridge 4, which in turn is adjacent to, in sequence, groove 5 and channel 6. The periphery of lid 1 passes from channel 6 and extends down pail 2 in projection 7. Non-linear flexible ribs 8 are located in groove 5, as more clearly shown elsewhere.

Pail wall 11 extends upwards and terminates in pail rim 12. Sealant 13 is located within channel 6 and above pail rim 12, to aid in sealing the contents of the pail within the pail. In addition, pail wall 11 has pail latch 14 extending externally therefrom. Projection 7 of lid 1 extends through latch orifice 15 located in pail latch 14.

Projection 7 is described herein as being substantially planar. In particular, projection 7 should be planar on its face towards wall 11 of pail 2, especially for ease of manufacture. The surface of projection 7 disposed away from wall 11 could be non-planar, especially rounded. However, it is preferred that projection 7 be planar on both faces, for both ease of manufacture and strength of projection 7, especially resistance to breakage on impact. Projection 7 terminates in forked lanceolate tip 22, discussed in greater detail below.

FIG. 1 shows optional lip 19 located on projection 7, within channel 6, on the inner exterior wall thereof. As shown, pail rim 12 is located above lip 19, extending over lip 19.

Figure 2:
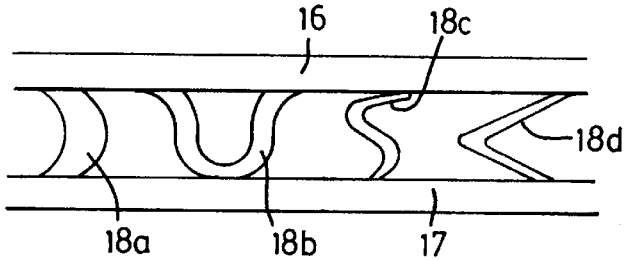
FIG. 2 is a schematic representation of elevational views of embodiments of the non-linear flexible ribs.

FIG. 2 shows non-linear flexible ribs located within groove 5. The ribs in FIG. 2 are viewed from above lid 1, looking down into groove 5. In particular, FIG. 2 shows four different examples of non-linear flexible ribs. It is understood that groove 5 would contain a plurality of non-linear flexible ribs that would normally be of the same shape and construction, not the assortment shown in FIG. 2 as examples of embodiments of the non-linear ribs. Non-linear flexible ribs 8 are intended to undergo flexing when compressed, and to exert a force opposing such compression.

In FIG. 2, walls 16 and 17 are the opposing walls of groove 5. Non-linear flexible ribs are indicated by 18, with rib 18*a* being substantially U-shaped, 18*b* being substantially sinusoidal in shape, 18*c* being substantially S-shaped and 18*d* being substantially V-shaped. It is understood that other non-linear flexible shapes could be used. Linear ribs transversely located between walls 16 and 17 i.e. extending across groove 5 substantially at right angles to the walls of groove 5, are not included within embodiments of the invention.

Figure 3A:
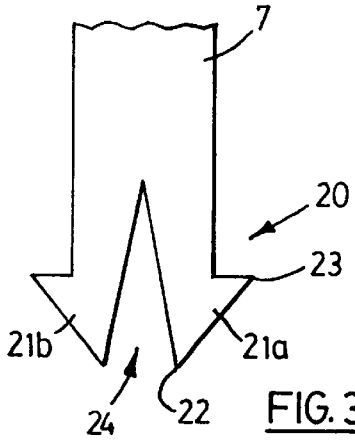
FIGS. 3A and 3B are schematic representations of the end of the projection that forms part of an embodiment of the lid.

FIG. 3A shows an embodiment of projection 7 which terminates in forked lanceolate tip 22, which is also shown in side view in FIG. 1. Forked lanceolate tip 22 is formed by tip heads 21*a* and 21*b* on separate tynes of tip 22, which are separated by tip gap 24. Tip heads 21*a* and 21*b* each form tip lip 23 that extends outwardly from projection 7.

Figure 3B:
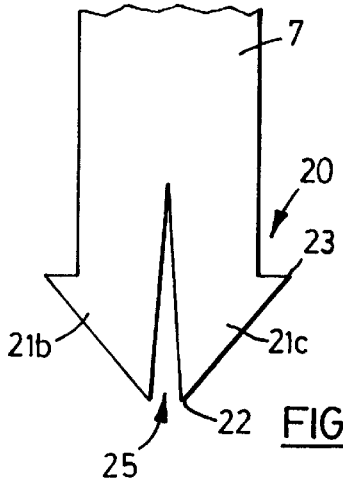

FIG. 3B is of similar construction to FIG. 3A, except that tip gap 25 is narrower in width than tip gap 24 shown in FIG. 3A. It is to be understood that the width of tip gaps 24 and 25 may be varied, but that a tip gap 24 as illustrated in FIG. 3A is preferred to the narrower tip gap 25 shown in FIG. 3B.

Figure 4:
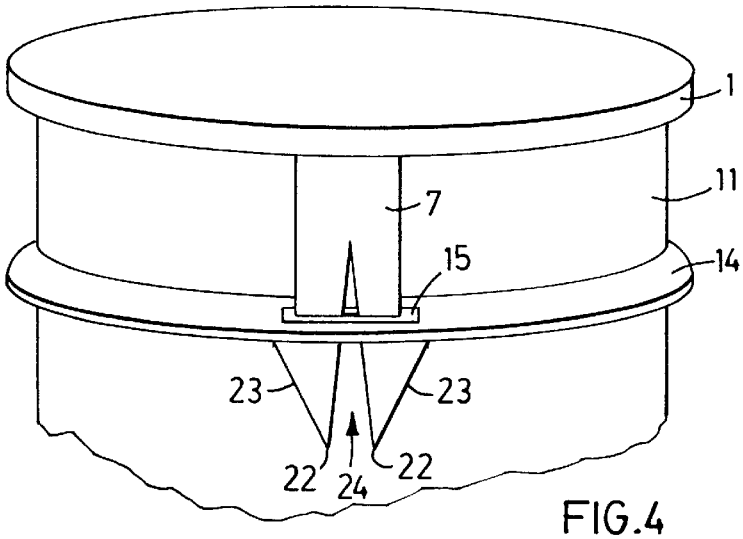
FIG. 4 is a schematic representation of a projection of FIG. 3A in a pail latch.

FIG. 4 shows pail wall 11 with pail latch 14 extending therefrom. In the embodiment shown, pail latch 14 is part of a rib that extends circumferentially around the entire pail, with pail latch 14 being a slot in such rib. It is to be understood, however, that pail latch 14 could be a projection on the exterior of the pail i.e. attached to pail wall 11, or it could alternatively be part of the housing for a handle on a pail with the handle of the pail being attached exterior to projection 7.

Forked lanceolate tip 22 is shown as having passed through pail latch orifice 15 such that tip lips 23 have passed through latch orifice 15 and have become locked on the underside of pail latch 14.

In FIG. 4, projection 7 is shown as extending downwardly from lid 1.

Figure 5:
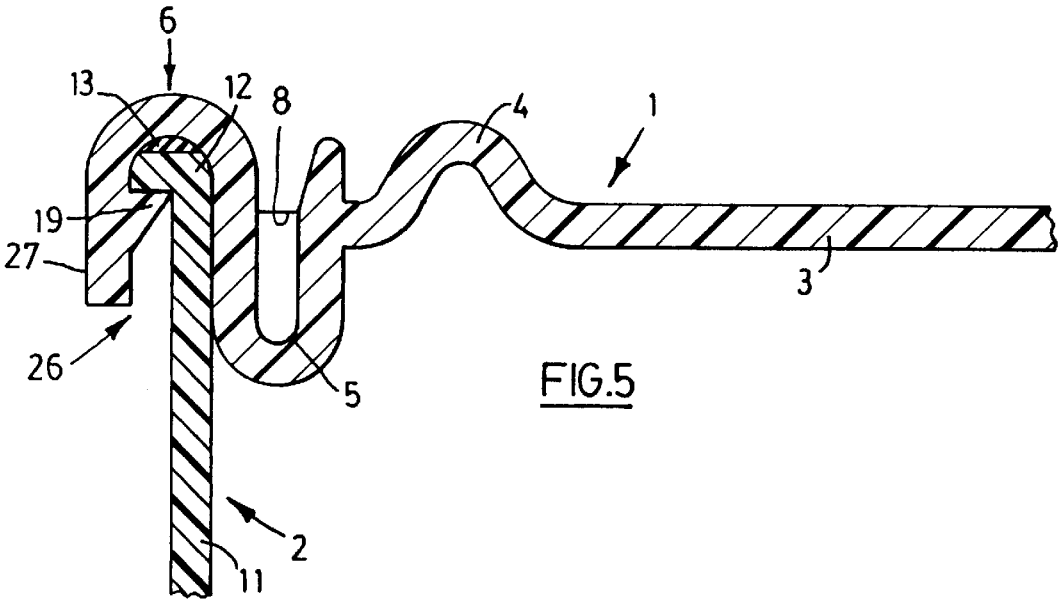
FIG. 5 is a schematic representation of an alternative embodiment a cross-section of a pail lid attached to a pail.

FIG. 5 shows an alternative embodiment of the present invention. In this embodiment, lid edge 27 of lid 1 extends downward, being shown as substantially parallel to pail wall 11. The length of lid edge 27 may be varied. However, in contrast to the embodiment of FIG. 1, latch orifice 15 and pail latch 14 have been omitted, and thus there is no projection. Thus, lid edge 27 terminates at edge rim 26, without passing through a latch orifice or otherwise being locked onto pail 2 by a latch extending from pail wall 11. It will be noted that in the embodiment shown, lid edge 27 has optional lip 19 that engages pail rim 12. It is understood that lid edge 27 would normally extend circumferentially around lid 1.

In use, a pail is filled with goods that are to be transported, and lid 1 is placed on the pail. If lid 1 has a projection 7, and the pail has a corresponding pail latch 14 with latch orifice 15, then projection 7 is inserted into latch orifice 15. The tip of projection 7 is constructed such that on being pushed through latch orifice 15, the tynes that form forked lanceolate tip 22 of projection 7 are urged inward towards each other as a result of contact of tip head 21*a* and 21*b* with the sides of latch orifice 15. When tip lip 23 has passed through latch orifice 15, the respective parts of tip head 21*a* and 21*b* spring apart, as a result of the elasticity within projection 7 and its tip, such that tip lips 23 become locked beneath pail latch 14. The result is that lid 1 cannot be removed or otherwise come off a pail without breaking of projection 7 or deliberately urging tip heads 21*a* and 21*b* together to effect removable of lid 1.

On impact of a pail having the lid as described herein with for instance a hard surface, pressure may be exerted on lid 1 as a result of movement of the contents of the pail. The central planar section 3 of lid 1 will tend to bow upwards. However, such pressure exerted by the contents on the lid is normally minor compared with the direct effects of impact of an edge of the lid with a hard surface. Such an impact would result in channel 6 tending to disengage, rapidly, from sealant 13 and pail 2. In particular, the wall of the lid extending down from channel 6 into groove 5 would tend to disengage from lid 1. In the absence of groove 5, lid 1 can easily pop off pail 2. Groove 5 in association with ridge 4 absorbs energy of impact. Moreover, the presence of non-linear flexible ribs 8 further absorbs the energy of impact, reducing the tendency for lid 1 to pop off pail 2. The section of groove 5 in contact with wall 11 of pail 2 is urged further into contact with wall 11, increasing the friction between the wall of groove 5 and wall 11, thereby making it more difficult to remove lid 1 from the pail. However, the effect of the impact is not fully and suddenly transmitted to the junction of the wall of groove 5 and wall 11, which might result in the popping off of lid 1 from pail 2. The non-linear flexible ribs 8 located within groove 5 absorb energy, and lessen the effect of the impact and especially lessen the potential effect of the impact to remove or separate lid 1 from pail 2.

Projection 7 in latch orifice 15 also resists the popping off of lid 1, either separately or in combination with non-linear flexible ribs.

It is understood that lid 1 may be used without a projection 7 that is intended to pass through latch orifice 15 located on the pail wall. However, in a preferred embodiment lid 1 has both non-linear flexible ribs 8 and projection 7.

It is understood that appropriate means could be provided within lid 1 to allow the contents of the pail to be removed without removal of lid 1 from pail 2. For instance, lid 1 could have an opening therein with a removable screw cap through which the contents could be poured. Alternatively, lid 1 could be equipped with a suitable spout system for use in removal of the contents. However, the lid may be such that it must be removed, even if cut off, in order to remove the contents of the pail.

It is believed that use of the ridge and groove disclosed herein, optionally with the non-liner flexible ribs, provides stiffness to the lid and will result in an ability to reduce the thickness of central planar section 3 of lid 1, for economic benefits while still maintaining acceptable performance.

The pail with lid is useful in the transportation of goods.

We claim:

1. A plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of U-shaped flexible ribs therein extending across the width of the groove.

2. A plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of sinusoidal flexible ribs therein extending across the width of the groove.

3. A plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of S-shaped flexible ribs therein extending across the width of the groove.

4. A plastic pail with a plastic lid, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of U-shaped flexible ribs therein extending across the width of the groove.

5. A plastic pail with a plastic lid, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of sinusoidal flexible ribs therein extending across the width of the groove.

6. A plastic pail with a plastic lid, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of S-shaped flexible ribs therein extending across the width of the groove.

7. A plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of non-linear flexible ribs therein extending across the width of the groove, said non-linear flexible ribs being U-shaped and undergoing flexing when subjected to compression and exerting a force opposing said compression.

8. A plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of non-linear flexible ribs therein extending across the width of the groove, said non-linear flexible ribs being sinusoidal and undergoing flexing when subjected to compression and exerting a force opposing said compression.

9. A plastic lid for a pail, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of non-linear flexible ribs therein extending across the width of the groove, said non-linear flexible ribs being S-shaped and undergoing flexing when subjected to compression and exerting a force opposing said compression.

10. A plastic pail with a plastic lid, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of non-linear flexible ribs therein extending across the width of the groove, said non-linear flexible ribs being U-shaped and undergoing flexing when subjected to compression and exerting a force opposing said compression.

11. A plastic pail with a plastic lid, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of non-linear flexible ribs therein extending across the width of the groove, said non-linear flexible ribs being sinusoidal and undergoing flexing when subjected to compression and exerting a force opposing said compression.

12. A plastic pail with a plastic lid, said lid having a substantially planar central section and a peripheral channel, said channel fitting over the pail to effect closure thereof, said central section being spaced from the channel by a groove and a ridge, each of which extend around the lid juxtaposed to the channel, with the groove being adjacent to the channel, said groove having a plurality of non-linear flexible ribs therein extending across the width of the groove, said non-linear flexible ribs being S-shaped and undergoing flexing when subjected to compression and exerting a force opposing said compression.

* * * * *